US005420609A

United States Patent [19]

Izzi et al.

[11] Patent Number: 5,420,609

[45] Date of Patent: May 30, 1995

[54] FRAME BUFFER, SYSTEMS AND METHODS

[75] Inventors: Louis J. Izzi, Plano, Tex.; Richard E. Downing, Hoffman Estates, Ill.

[73] Assignee: Texas Instruments Incorporated, Dallas, Tex.

[21] Appl. No.: 143,335

[22] Filed: Oct. 26, 1993

Related U.S. Application Data

[63] Continuation of Ser. No. 723,342, Jun. 28, 1991.

[51] Int. Cl.[6] ..... G09G 1/02

[52] U.S. Cl. ..... 345/190; 345/199

[58] Field of Search ..... 345/190, 199; 307/239, 307/240, 241, 242, 243, 244; 328/103, 104, 105, 106, 152, 153, 154

[56] References Cited

U.S. PATENT DOCUMENTS 4,769,632 9/1988 Work et al. .

4,815,033 3/1989 Harris .

OTHER PUBLICATIONS

Brooktree, "Bt459", *Product Data Book, 1989,* 1989, pp. 5–85 through 5–115.

Texas Instruments Incorporated, "TMS34070–2–Color Palatte", *Production Data,* 1986 pp. 1–15.

Brooktree, "RAMDAC Products", *Winter 1990 Product Selection Guid,* Winter, 1990, pp. 9–15.

*Primary Examiner*—Ulysses Weldon

*Assistant Examiner*—Matthew Luu

*Attorney, Agent, or Firm*—Robert D. Marshall, Jr.; James C. Kesterson; Richard L. Donaldson

[57] ABSTRACT

A frame buffer is provided, including a plurality of input nodes and a plurality of multiplexing circuits. Each multiplexing circuit has a first input coupled to a respective input node. First control circuitry is provided for selectively coupling a second input of each multiplexer circuit to outputs of others of the multiplexing circuits. Second control circuitry is coupled to each multiplexing circuit for selecting between the first and second inputs.

8 Claims, 14 Drawing Sheets

FRAME BUFFER, SYSTEMS AND METHODS

CROSS-REFERENCE TO RELATED APPLICATIONS

This application is a continuation of U.S. application Ser. No. 07/723,342, filed Jun. 28, 1991.

The following patent application, assigned to Texas Instruments Incorporated, the assignee of the present application, and is cross-reference and incorporated into present application by reference.

| Ser. No. | Docket No. | Title |
|---|---|---|
| 07/544,775 | TI-15123 | PACKED BUS SELECTION OF MULTIPLE PIXEL DEPTHS IN PALETTE DEVICES, SYSTEM AND METHODS |

Notice (C) Copyright, Texas Instruments Incorporated, 1990. A portion of the Disclosure of this patent document contains material which is subject to copyright protection. The copyright owner has no objection to facsimile reproduction by anyone of the patent document or the patent disclosure, as it appears in the U.S. Patent and Trademark Office, patent file or records, but otherwise reserves all rights in its copyright whatsoever.

TECHNICAL FIELD OF THE INVENTION

The present invention relates in general to memories and in particular, to a sequential access memory, systems and methods.

BACKGROUND OF THE INVENTION

Without limiting the general scope of the invention, its background is described in connection with computer graphics, as an example only.

In computer graphics systems, the low cost of dynamic random access memories (DRAM) has made it economical to provide a bit map or pixel map system memory. In such a bit map or pixel map memory, a color code is stored in a memory location corresponding to each pixel to be displayed. A video system is provided which recalls the color codes for each pixel and generates a raster scan video signal corresponding to the recalled color codes. Thus, the data stored in the memory determine the display by determining the color generated for each pixel (picture element) of the display.

The requirement for a natural looking display and the minimization of required memory are conflicting. In order to have a natural looking display, it is necessary to have a large number of available colors. This, in turn, necessitates a large number of bits for each pixel in order to specify the particular color desired from among a large number of possibilities. The provision of a large number of bits per pixel, however, requires a large amount of memory for storage. Since a number of bits must be provided for each pixel in the display, even a modest size display would therefore require a large memory. Thus, it is advantageous to provide some method to reduce the amount of memory needed to store the display while retaining the capability of choosing among a large number of colors.

The provision of a circuit called a color palette enables a compromise between these conflicting requirements. The color palette stores color data words which specify colors to be displayed in a form that is ready for digital-to-analog conversion directly from the color palette. The color codes stored in the memory for each pixel have a limited number of bits, thereby reducing the memory requirements. The color codes are employed to select one of a number of color registers or palette locations. Thus, the color codes do not themselves define colors, but instead, identify preselected palette locations. These color registers or palette locations each store color data words which are longer than the color codes in the pixel map memory. The number of such color registers or palette locations provided in the color palette is equal to the number of selections provided by the color codes. For example, a 4-bit color code can be used to select $2^4$ or 16 palette locations. The color data words can be redefined in the palette from frame to frame to provide many more colors in an ongoing sequence of frames than are present in any one frame.

For overall operational efficiency, circuitry is required which can convert the color codes stored in the graphic system memory into addresses for retrieving the color data words from the corresponding palette locations. For compatibility with a wide-range of graphics processing systems, such circuitry should be able to operate in conjunction with control signals having speeds on the order of 140 Mz. Thus, any improvement in the circuitry converting color codes to color words is advantageous.

Due to the advantages of color palette devices, systems and methods, any improvement in their implementation is advantageous in computer graphics technology.

SUMMARY OF THE INVENTION

According to the invention, the frame buffers provided which includes a plurality of input nodes and a plurality of multiplexing circuits. Each of the multiplexing circuits has a first input coupled to a respective input node. First control circuitry is provided which selectively couples the second input of each of the multiplexer circuits to the outputs of others of the multiplexing circuits. Second control circuitry is also provided which is coupled to each of the multiplexer circuits for selecting between the first and second inputs.

The present invention allows for the high-speed conversion of a multi-bit word received at the input nodes into at least one output word. According to further aspects of the invention, a multi-bit color code is received at the inputs and a corresponding plurality of color data words addressing an associated palette memory output.

BRIEF DESCRIPTION OF THE DRAWINGS

For a more complete understanding of the illustrated embodiments of the present invention, and the advantageous thereof, reference is now made to the following descriptions, taken in conjunction with the accompanying drawings, in which:

FIG. 8 is a functional block diagram of a selected pair of bit paths shown in FIG. 6, including provision for VGA pass through;

DETAILED DESCRIPTION OF PREFERRED EMBODIMENTS

Figure 1:
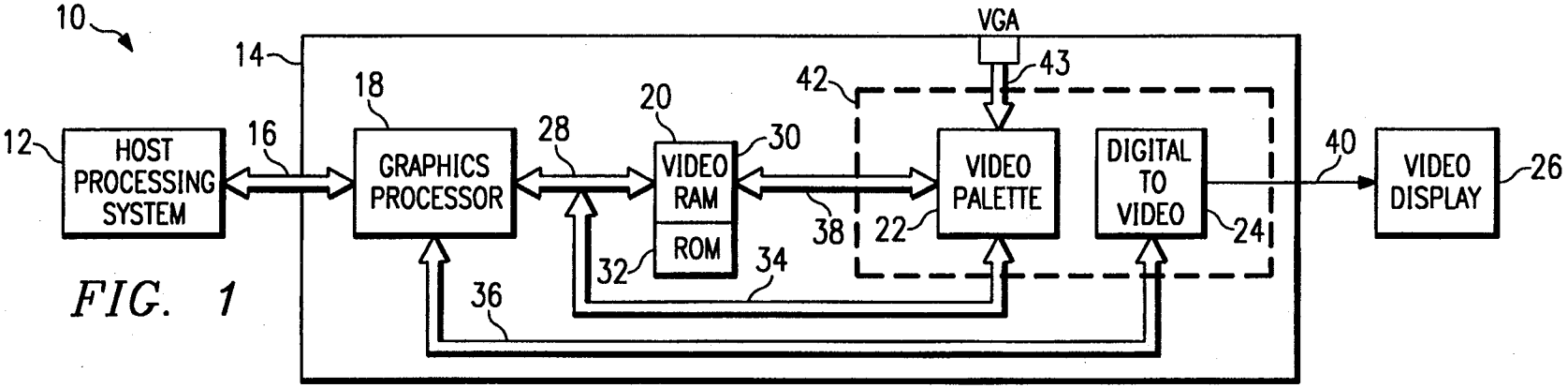
FIG. 1 is a functional block diagram of a graphics processor system utilizing one embodiment of the present invention.

Referring first to FIG. 1, a block diagram of a graphics computer system 10 is depicted as constructed in accordance with the principles of the illustrated embodiment of the present invention. For clarity and brevity in understanding the inventive concepts herein, a detailed description of the complete graphics processing system will not be provided. A more complete detailed discussion, however, can be found in patent application Serial No. 07/544,775, filed Jun. 24, 1990, (attorneys' docket no. TI-15123), assigned to the assignee of the present application and hereby incorporated by reference. Also incorporated by reference herein are Texas Instruments TMS 34010 User's Guide (August 1988); TIGA-340 (TM) Interface, Texas Instruments Graphics Architecture, User's Guide, 1989; TMS 34020 User's Guide (January 1990); and TMS 44C251 Specification, all of which documents are currently available to the general public from Texas Instruments Incorporated. These documents give a more thorough description of graphics processing systems in general.

Graphics computer system 10 includes a host processing system 12 coupled to a graphics printed wiring board 14 through a bidirectional bus 16. Located on printed wiring board 14 are a graphics processor 18, memory 20, a video palette 22 and a digital-to-video converter 24. Video display 26 is driven by graphics board 14.

Host processing system 12 provides the major computational capacity for graphics computer system 10 and determines the content of the visual display to be presented to the user on video display 26. The details of the construction of host processing system 12 are conventional in nature and known in the art and therefore will not be discussed in further detail herein.

Graphics processor 18 provides the data manipulation capability required to generate the particular video display presented to the user. Graphics processor 18 is bidiectionally coupled to processing system 12 via bus 16. While graphics processor 18 operates as a data processor independent of host processing system 12, graphics processor 18 is fully responsive to requests output from host processing 12. Graphics processor 18 further communicates with memory 20 via video memory bus 28. Graphics processor 12 controls the data stored within video RAM 30, RAM 30 forming a portion of memory 20. In addition, graphics processor 18 may be controlled by programs stored in either video RAM 30 or in read-only memory 32. Read-only memory 32 may also include various types of graphic image data, such as alpha numeric characters in one or more font styles and frequently used icons. Further, graphics processor 12 controls data stored within video palette 22 via bidirectional bus 34. Finally, graphics processor 18 controls digital-to-video converter 24 via video control bus 36.

Video RAM 30 contains bit map graphic data which control the video image presented to the user as manipulated by graphics processor 18. In addition, video data corresponding to the current display screen are output from video RAM 30 on bus 38 to video palette 22. Video RAM 30 may consist of a bank of several separate random access memory integrated circuits, the output of each circuit typically being only one or 4 bits wide as coupled to bus 38.

Video palette 22 receives high speed video data from video random access memory 30 via bus 38 and data from graphics processor 18 via bus 34. In turn, video palette 22 converts the data received on bus 38 into a video level which is output on bus 40. This conversion is achieved by means of a look-up table which is specified by graphics processor 18 via video memory bus 34. The output of video palette 22 may comprise color, hue and saturation signals for each picture element or may comprise red, green and blue primary color levels for each pixel. Digital-to-video converter 24 converts the digital output of video palette 22 into the necessary analog levels for application to video display 26 via bus 40.

Printed wiring board 14 also includes a VGA pass-through port 43 coupled to palette 42. In the VGA pass-through mode, data from the VGA connector of most VGA supported personal computers is fed directly into palette 42 without the need for external data multiplexing. This allows a replacement graphics board to remain "downward compatible" utilizing the existing graphic circuitry often located on the mother board of the associated post processing system 12.

Video palette 22 and digital-to-video converter 24 may be integrated together to form a "programmable palette" 42 or simply "palette" 42.

Video display 26 receives the video output from digital-to-video converter 24 and generates the specified video image for viewing by the user of graphics computer system 10. Significantly, video palette 22, digital-to-video converter 24 and video display 26 may operate in accordance with either of two major video techniques. In the first technique, video data are specified in terms of color, hue and saturation for each individual pixel. In the second technique, the individual primary color levels of red, blue and green are specified for each individual pixel. Upon selection of the desired design using either of these two techniques, video palette 22, digital-to-video converter 24 and video display 26 are customized to implement the selected technique. However, the principles of the present invention in regard to the operation of the graphics processor 18 are unchanged regardless of the particular design choice of the video technique. All of the signals that contribute to display color in some way are regarded as color signals even though they may not be of the red, blue, green technique.

Figure 2:
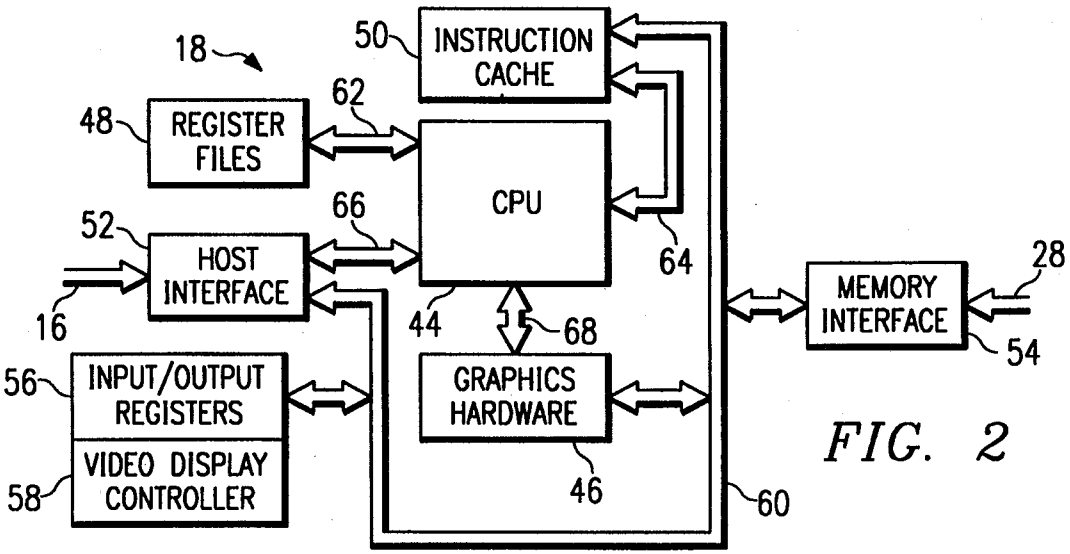
FIG. 2 is a more detailed functional block diagram of a graphics processor for use with the invention.

FIG. 2 illustrates graphics processor 18 in further detail. Graphics processor 18 includes central processing unit 44, graphics hardware 46, register files 48, instruction cache 50, host interface 52, memory interface 54, input/output registers 56 and video display controller 58.

The central processing unit 44 performs a number of general purpose data processing functions including arithmetic and logic operations normally included in a general purpose central processing unit. In addition, central processing unit 44 controls a number of special purpose graphics instructions, either alone or in conjunction with graphics hardware 46.

Graphics processor 18 includes a major bus 60 which is connected to most parts of graphics processor 18, including central processing unit 44. Central processing unit 44 is bidirectionally coupled to a set of register files 48, including a number of data registers, via bidirectional register bus 62. Register files 48 serve as the repository of the immediately accessible data used by central processing unit 44.

Central processing unit 44 is also connected to instruction cache 50 by instruction cache bus 64. Instruction cache 50 is further coupled to bus 60 and may be loaded with instruction words from video memory 20 (FIG. 1) via video memory bus 28 and memory interface 54. The purpose of instruction cache 50 is to speed up the execution of certain functions of central processing unit 44. For example, a repetitive function that is often used within a particular portion of the program executed by central processing unit 44 may be stored within instruction cache 50. Access to instruction cache 50 via instruction cache bus 64 is much faster than access to video memory 20 and thus, the overall program executed by central processing unit 44 may be sped up by a preliminary loading of the repeated or often used sequences of instructions within instruction cache 50.

Host interface 52 is coupled to central processing unit 44 via host interface bus 66. Host interface 52 is further connected to host processing system 12 via host system bus 16. Host interface 52 serve to control the communications between host processing system 16 and graphics processor 18. Typically, host interface 52 would communicate graphics requests from the host processing system 16 to graphics processor 18, enabling host system 16 to specify the type of display to be generated by video display 26 and causing graphics processor 18 to perform a desired graphic function.

Central processing unit 44 is further coupled to graphics hardware 46 via graphics hardware bus 68. Graphics hardware 46 is additionally connected to major bus 60. Graphics hardware 46 operates in conjunction with central processing unit 44 to perform graphic processing operations. In particular, graphics hardware 46 under control of central processing 44 is operable to manipulate data within the bit map portion of video RAM 30.

Memory interface 54 is coupled to bus 60 and further coupled to video memory bus 28. Memory interface 54 serves to control the communication of data and instructions between graphics processor 18 and memory 20. Memory 20 includes both the bit map data to be displayed on video display 26 and the instructions and data necessary for the control and operation of graphics processor 18. These functions include control of the timing of memory access, and control of data and memory multiplexing.

Graphics processor 18 also includes input/output registers 56 and a video display controller 58. Input/output registers 56 are bidirectionally coupled to bus 60 to enable reading and writing within these registers. Input/output registers 56 are preferably within the ordinary memory space of central processing unit 44. Input/output registers 56 contain data which specify the control parameters of video display controller 58. In accordance with the data stored within the input/output registers 56, video display controller 58 controls the signals on video control bus 36 for the desired control of palette 42. For example, data within input/output registers 56 may include data for specifying the number of pixels per horizontal line, the horizontal synchronization and blanking intervals, the number of horizontal lines per frame and the vertical synchronization and blanking intervals.

Figure 3:
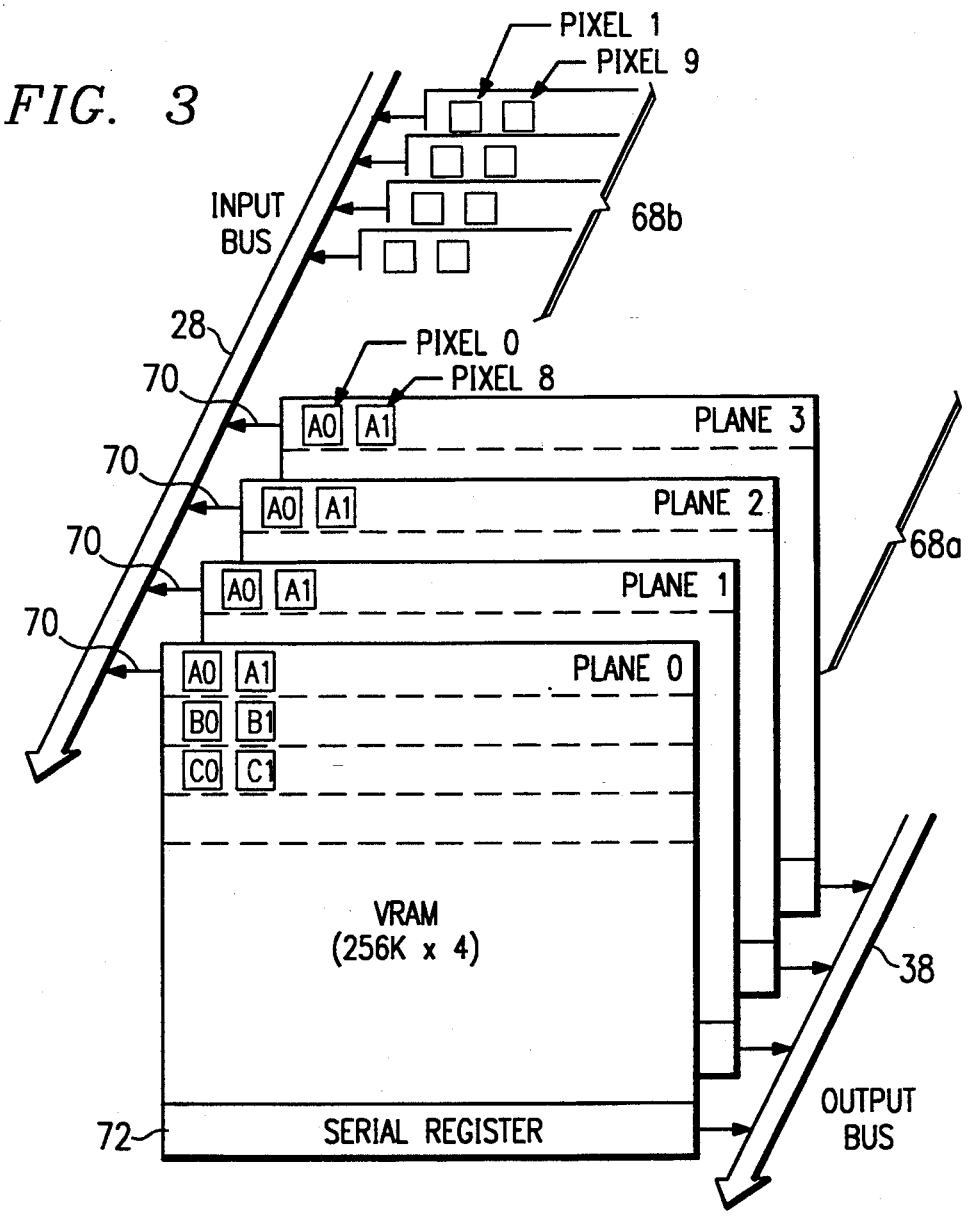
FIG. 3 is a schematic diagram depicting a preferred architecture for video RAM depicted in FIG. 1.

Referring next to FIG. 3 a typical graphics memory system configuration for video RAM 30 is depicted in which eight VRAM memories 68 are used as an array, two of which are depicted as **68*a* and 68*b*. Each VRAM memory 68, or unit, includes four sections, or planes, 0, 1, 2 and 3. The construction of each plane is such that a single data lead 70 is used to write information to that plane. In a system which uses a 32-bit data bus, such as data bus 28, there would be eight VRAM memories, each VRAM memory having four data leads connected to-the input data bus. For example, for 32-bit data bus 28, VRAM memory 68*a* would have its four data leads 70 connected to data bus 28 leads 0, 1, 2, and 3, respectively. Likewise, the next VRAM memory 68*b* would have its four leads 0, 1, 2, and 3 connected to data bus 28 leads 4, 5, 6, and 7, respectively. This pattern continues for the remaining six VRAMs such that the last VRAM has its leads connected to leads 28, 29, 30, 31 (not shown) of bus 28**.

The VRAM memories 68 are arranged such that the pixel information for the graphics display is stored serially across the planes in the same row. Assuming a 4-bit per pixel system, then the bits for each pixel are stored in separate VRAM memory. In such a situation, pixel 0 would be the first VRAM **68*a* and pixel 1 would be the second VRAM 68*b*. The pixel storage for pixels 2–7 are not shown, but these would be stored in column 1 of VRAMS 68*c*, *d*, *e*, *f*, *g* and *h*. The pixel information for pixel 8 would be stored in the first VRAM 68*a*, still in row A, but in column 2** thereof.

Each VRAM plane has a serial register 72 for shifting out information from a row of memory. In the preferred embodiment, the shifting out is performed in response to a shift clock signal SCLK (not shown) generated on palette 42 (FIG. 1). The outputs from these registers are connected to bus 38 in the same manner as the data input leads are connected to input bus 28. Thus, data from a row memory, such as row A, would be moved into register 72 and output serially from each register 72 and in parallel on bus 38. This would occur for each plane of the eight VRAM memory array.

The memory configuration depicted in FIG. 3 is not limited to the handling of 4-bit pixel description data. For example, if the information for each pixel was to be described in eight bits, then two VRAMs 68 would be required per pixel. Further, for increased ability in handling data, shift registers 72 would be split in half with each half used to output data onto bus 38. The split register approach allows for differences in the number of pixels required by the display and the number of bits per pixel desired. A more complete description of this feature can be found in co-assigned application Ser. No. 07/544,775 (Attorneys' Docket No. TI-15123) and hence, will not be repeated here.

Returning to FIGS. 1 and 2, graphics processor 18 operates in two different address modes to address memory 20. These two address modes are X-Y addressing and linear addressing. In linear addressing, the start of a field is formed by a single multibit linear address. The field size is determined by the data within a status register within central processing unit 44. In X-Y addressing, the start address is a pair of X and Y coordinate values. The field size is equal to the size of a pixel, that is, the number of bits required to specify the particular data of a particular pixel.

Figure 4:
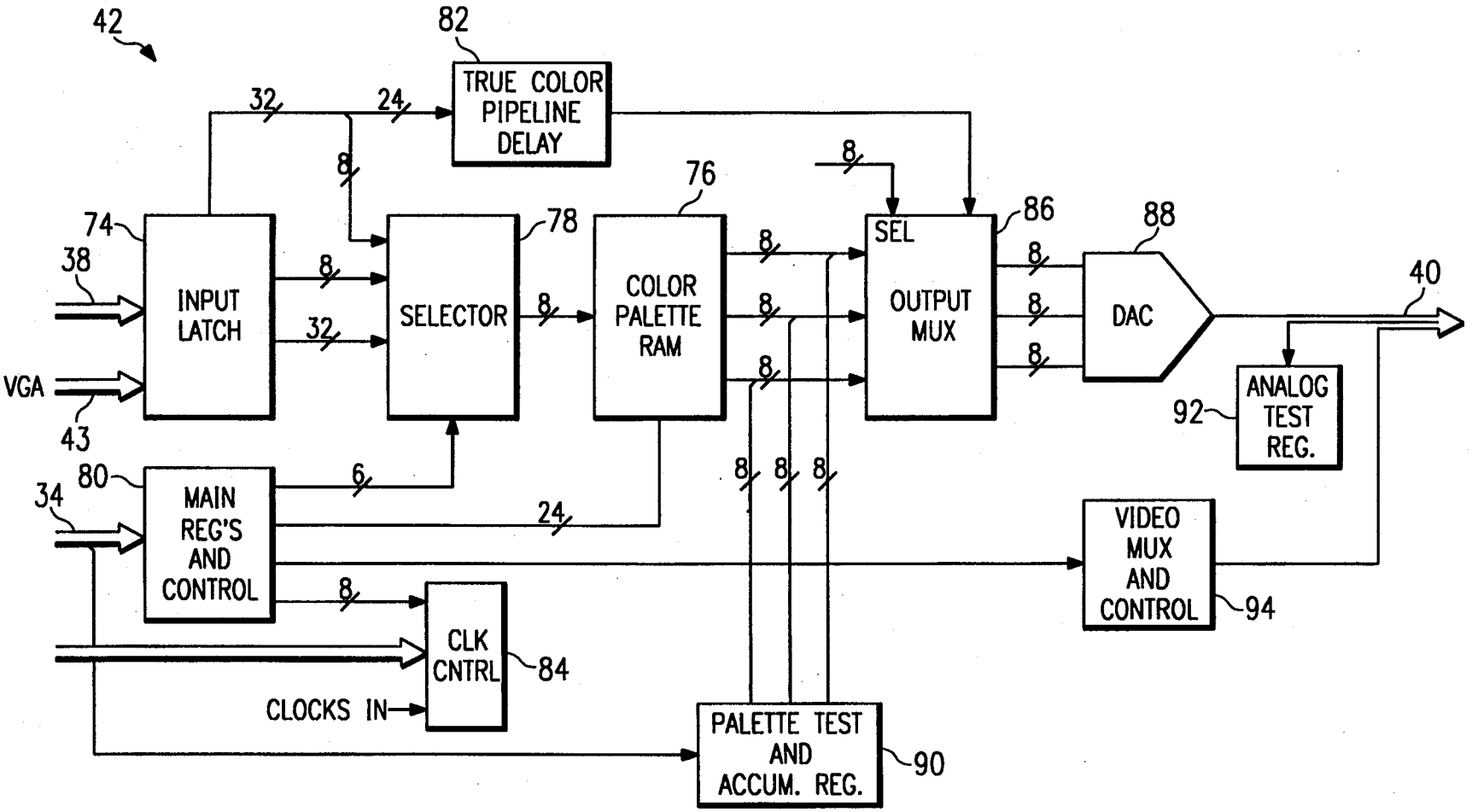
FIG. 4 is a functional block diagram of a video palette depicted in FIG. 1.

FIG. 4 is a more detailed depiction of palette 42 emphasizing the color palette RAM and the circuitry controlling it. Palette 42 includes an input latch 74 coupled to video memory 20 (see FIG. 1) via bus 38. In the preferred embodiment, input latch 74 receives color codes output from eight VRAM memories 68 comprising video RAM memory 30. Color palette RAM 76 provides color data words in response to color codes received at input latch 74. Selector 78 couples color palette RAM 76 and input latch 74, in the illustrated embodiment receiving 32 bits of color code data from latch 74 and outputting 8 bits of address data to color palette RAM 76. In the illustrated embodiment color palette RAM 76 is a high speed dual-port static RAM (SRAM); however, color palette RAM 76 may also be implemented using dynamic random access memories (DRAMs).

Graphics processor 18 (FIG. 2) controls the contents of the color data words output to video display 26 in response to color codes received at latch 74 by the reading and writing of color data words into and out of color palette RAM 76 using registers and control circuitry 80 and bus 34. Palette 42 also includes true color pipeline delay 82, clock control circuitry 84, output multiplexer 86 and digital-to-analog converters 8. Also depicted in FIG. 4 are palette test and accumulator registers 90, analog test registers 92, and video multiplexer and control circuitry 94. For a more complete description of these components, reference is made to pending application Ser. No. 07/544,775 (Attorney's Docket No., TI-15123) incorporated herein by reference.

Palette 42 also is operable in a "nibble mode". The "nibble mode" is used in a system configuration such as that depicted in FIG. 3 in which graphics processor 18 controls two VRAM's 20*a* and 20*b*. VRAM 20*a* has four VRAM sections with 4-bit nibble-wide shift registers 72 operating in parallel to supply 16 bits of output connected to the high four nibbles of each byte of a four-byte wide input latch 74. VRAM 20a also has four VRAM sections each with 4-bit nibble-wide outputs and has 16 bits of output connected to the low four nibbles respectively of the 4 bytes of input latch 72. In the nibble mode, palette 42 can switch between VRAM 20*a* and VRAM 20*b*. For example, to switch between two different images. Graphics processor 18 outputs a signal NIBBLE FLAG which directs palette 42 to output to display 26 either the four high nibbles or the four low nibbles. For a complete system level description of this special nibble mode, reference is again made to pending application, Ser. No. 07/544,775 (Attorney's Docket No. TI-15123).

Figure 5:
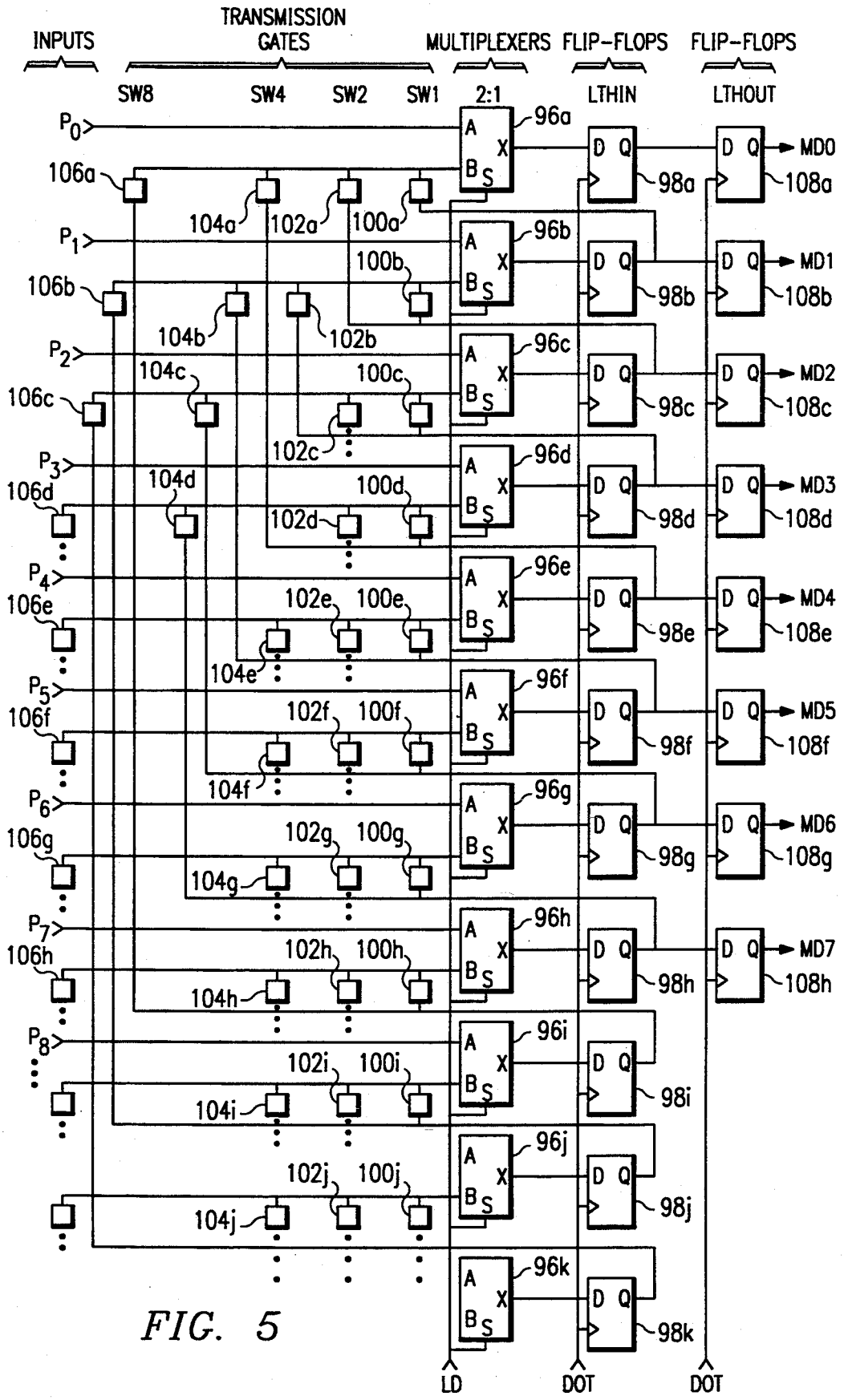
FIG. 5 is a simplified functional block diagram of selector shown in FIG. 4 according to one embodiment of the invention.

FIG. 5 is a more detailed block diagram of a portion of selector 78 (also known as the "frame buffer"). In the preferred embodiment, selector 78 receives 32 bits of red, green and blue color codes from video RAM 34 and outputs four corresponding 8-bit addresses. In FIG. 5, only nine inputs ($P_0$–$P_8$) of the 32 inputs $P_0$–$P_{31}$) of the preferred embodiment (see FIG. 6) are shown for convenience. It is important to recognize that numerous configurations are possible, such varying numbers of input bits and output bits can be handled. In the preferred embodiment, selector 78 is configurable to receive color codes of either 4, 8, 16 or 32 bits and to output a corresponding number of 1, 2, 4, or 8-bit addresses, each addressing a location in RAM 76, in response.

Selector 78 includes a bank of 2:1 multiplexers 96 each having an A data input coupled to a respective input P. In the preferred embodiment, 32 multiplexers 96 are provided which transfer 32 bits of address data (color codes) which arrive at the inputs $P_0$–$P_{31}$ to a corresponding bank of 32 latches 98. The multiplexers pass data from the A inputs to the multiplexer outputs on the rising edge of signal LD and then hold the data until the next DOT clock arrives. The DOT Clock signal DOT latches the 32-bit word from multiplexers 92 into the bank of 32 latches 98 and at the same time, toggles control signal LD, thereby switching the 2:1 multiplexers to select the B data inputs. See FIG. 6 and the accompanying text below for a more complete understanding of this switching process.

The B inputs of 2:1 multiplexers 96 are fed from an array of transmission gates configured in four groups comprising 8, 4, 2, and 1-bit sections. Transmission gates 100 comprise the 1-bit section, transmission gates 102 comprise the 2-bit section, transmission gates 104 comprise the 4-bit section and transmission gates 106 comprise the 8-bit section. One set of transmission gates 100–106 is activated at any one time.

The inputs of transmission gates 100–106 are respectively coupled to the Q outputs of the 32 latch bank of latches 98. Each successive row of transmission gates is fed from the latches 98 of the rows below such that data can be shifted upward toward the least significant bit MD$\phi$ (the "LSB"). Since a new 32 bit word arrives and is switched through selector 78 with every LD, each DOT clock is used to shift groups of data upward through the active transmission gate group during the interval between each rising edge of LD (the "LD clock interval"). Thus, if transmission gates 100 (the 1 bit group) are activated the data are shifted up by 1 bit, if transmission gates 102 are activated (the 2 bit group) the data are shifted up 2 bits, if transmission gates 104 are activated (the 4 bit group) the data are shifted up 4 bits, and if transmission gates 106 (the 8 bit group) are activated the data are shifted up 8 bits.

In the preferred embodiment, the 8 bit address output of selector 78 to color palette RAM 76 is made through a bank of eight latches 108 also clocked by clock signal DOT. Each DOT clock that initiates an upward data shift also latches and outputs the 8 bit result of the previous shift through latches 108. Further, it is important to note that in the preferred operating mode, a continuous flow of the 32-bit words of color codes are received by selector 78. For high speed operation therefore, the first DOT after signal LD not only latches the new 32 bit word into latches 98, but it also latches and outputs the last 8 bit word address of the last 32-bit word received.

Selector 78 (the frame buffer) always outputs an 8-bit address regardless of the number of bits of color data output per pixel. A page register (not shown) is therefore used which makes up the missing most significant bits of any given address when the number of bits per address word output is less than 8.

Figure 6A:
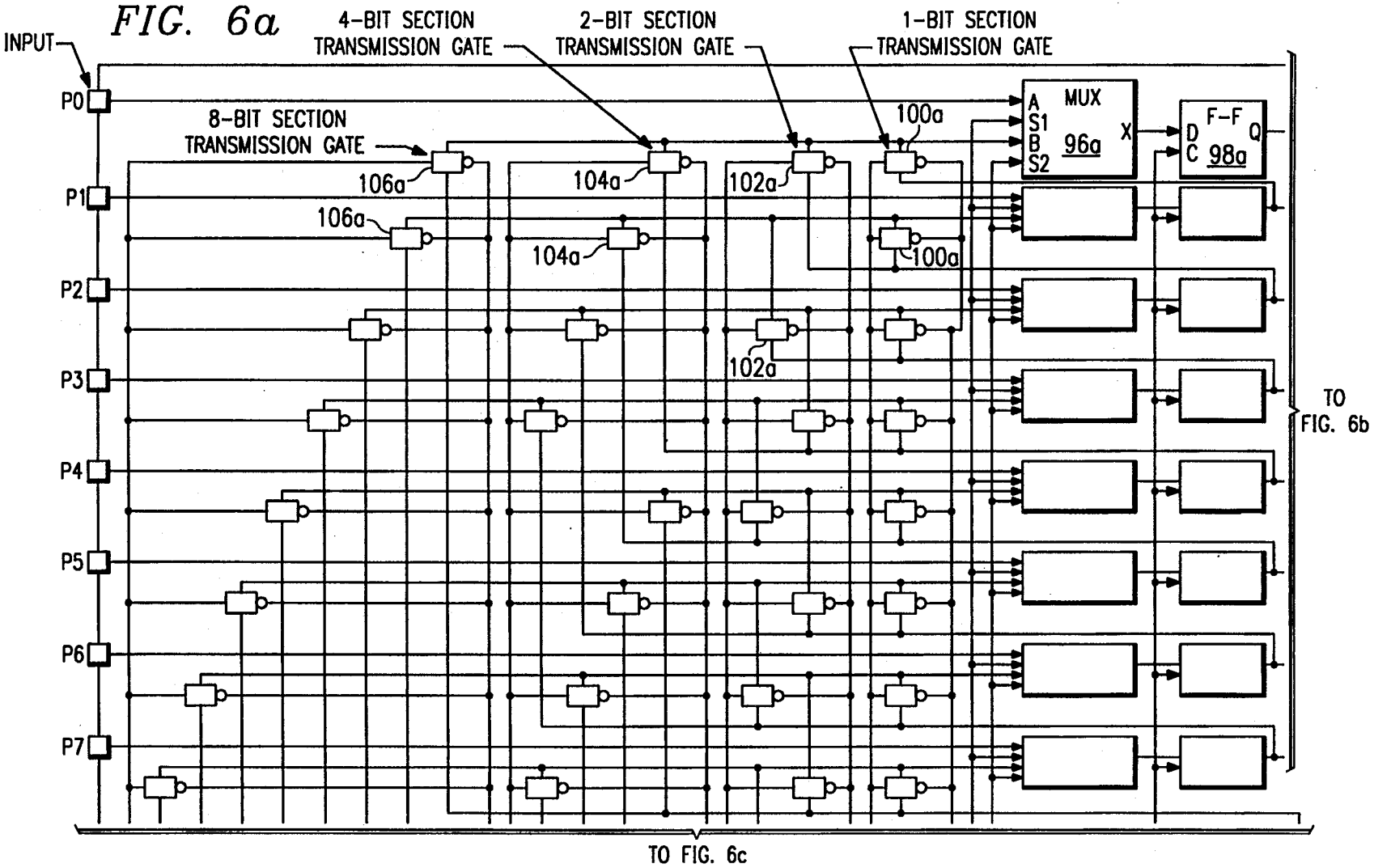
FIGS. 6a–6f are a complete electrical schematic diagram of the selector shown in FIG. 4 according to one embodiment of the invention.
Figure 6B:
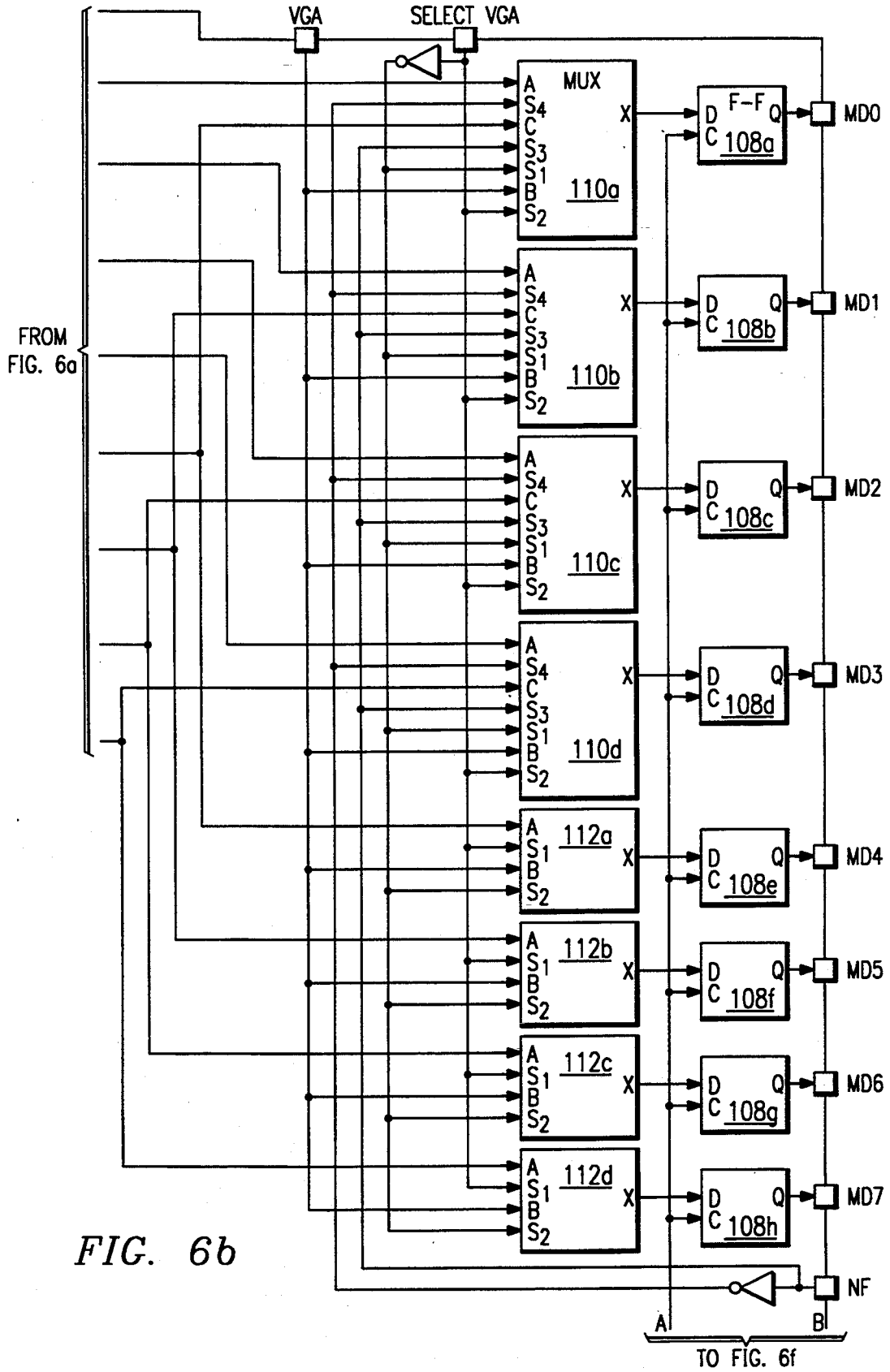
Figure 6C:
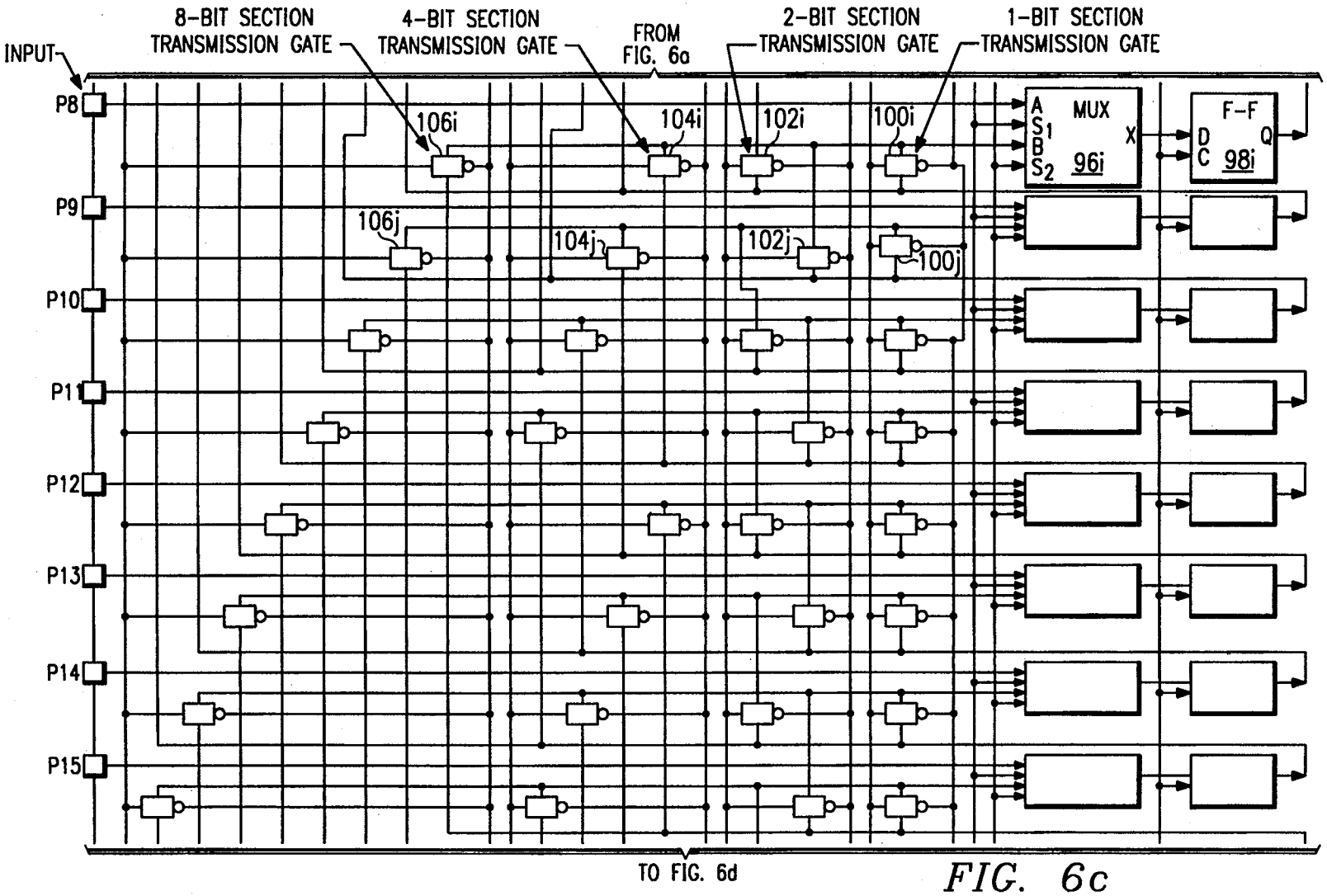
Figure 6D:
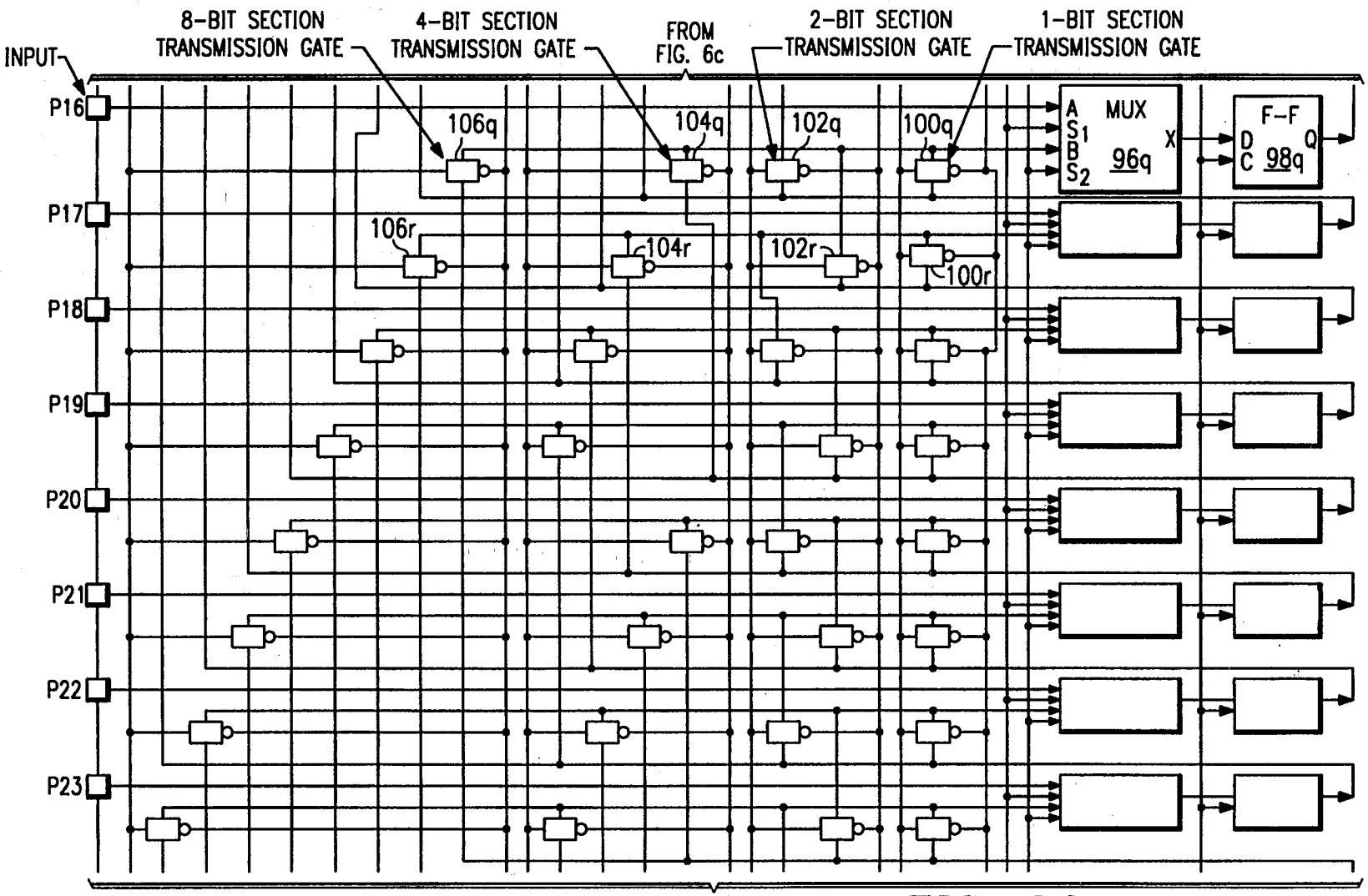
Figure 6E:
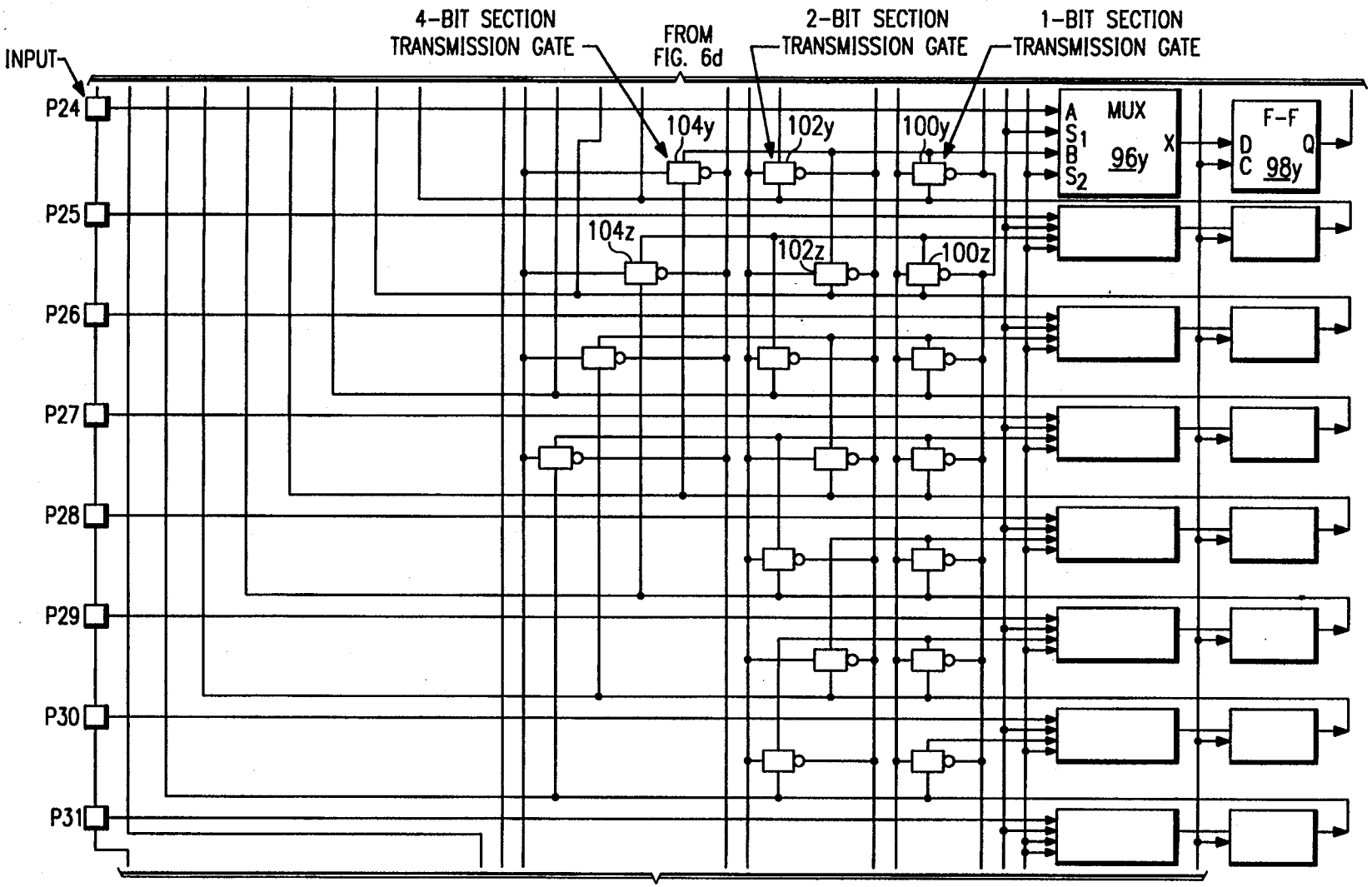
Figure 6F:
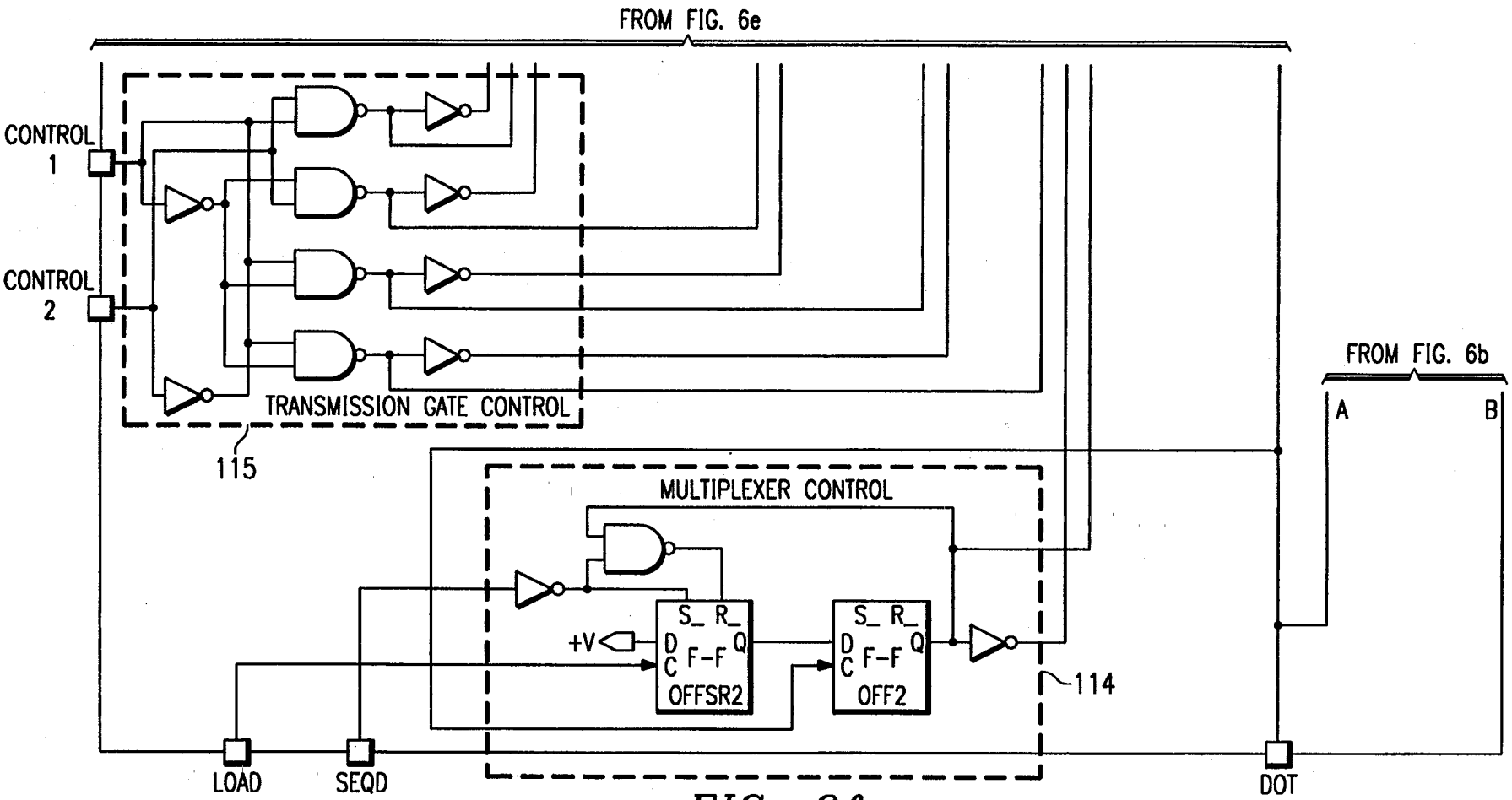

FIGS. 6*a*–f are a complete schematic diagram of selector 78 shown in FIG. 5. FIG. 6 further depicts a second set of multiplexers, including 3:1 multiplexers 110 (see, e.g., FIG. 6*b*) and 2:1 multiplexers 112 (FIG. 6*b*), multiplexer control circuitry 114 (FIG. 6*f*) and transmission gate control circuitry 115 (FIG. 6*f*). Multiplexers 110 and 112 are operable to switch VGA pass through signals directly to the outputs $MD_0$–$MD_7$ and provide for the "special nibble mode".

Multiplexer control circuitry 114 determines the relationship between signal LOAD and the DOT clock. Multiplexer control circuitry 114 operates in two modes. In the first mode, control signal SEQD is set high (to a logic "1") by CLOCK control circuitry 84 such that control signal LD is forced high and its complement LD is forced low (to a logic "0") which in turn forces multiplexers 96 to always look at the data arriving at inputs $P_x$ and never at the "wrap data" appearing at the B inputs of multiplexers 96. In this mode, since new pixel information (a new color data word) arrives on every DOT edge no "wrapping" is required. In this case, the eight least significant bits received at inputs $P_0$–$P_7$ are received and clocked directly to outputs $MD_0$–$MD_7$. With each DOT clock, multiplexer control circuitry 115 outputs a signal LD, thereby selecting the A inputs of multiplexers 96. (Therefore, in this mode, multiplexer control circuitry 114 never outputs a signal $\overline{LD}$ such that the B inputs of multiplexers 96 can be selected for "wrapping data".) The result is a continuous stream of addresses corresponding to the data received at inputs $P_0$–$P_7$ is clocked through to input $MD_0$–$MD_7$.

In the second operating mode, when data shifting among latches 98 (FIG. 5) is desired, control signal SEQD is set low. In this mode of operation, signal LD, which switches the inputs of multiplexers 96 to receive data at the A inputs, is set to a logic "1" (and correspondingly $\overline{LD}$ is set to a logic "0") on the first DOT clock after receipt of the control signal LOAD. On the second DOT clock after signal LOAD is received, select signal LD goes high and signal LD goes low such that the B inputs of multiplexers 96 are activated and data shifting can occur. Signal $\overline{LD}$ remains high until the first DOT clock after receipt of the subsequent rising edge of control signal LOAD.

The interval between rising edges of control signal LOAD is equal to the number of bits in the color code received at inputs $P_0$–$P_{31}$ divided by the number of bits of each of the addresses to be output on outputs $MD_0$–$MD_7$. For example, if a 32 bit color data word is received at inputs $P_0$–$P_{31}$ and 8-bits per pixel is desired at outputs $MD_0$–$MD_7$, for DOT clocks occur between each rising edge of control signal LOAD. Thus, each of the four 8-bit addresses making up the 32-bit color code can be shifted upward and latched prior to the switching of a new 32-bit color code through multiplexers 96. It is important to note that when control signal LOAD is equal to the DOT clock, i.e., when 8-bit color codes are being received and 8-bit addresses are being output, clock control circuitry 84 sets control signal SEQD high which in turn forces signal LD high such that multiplexers 96 never switch to pass data from their B data inputs and no shifting occurs.

Transmission gate control circuitry 115 activates the selected group of transmission gate groups 100, 102, 104, and 106 to achieve the desired "data wrapping." Signals CONTROL 1 and CONTROL 2 are set such that each divide ratio of the DOT clock to control signal LOAD will activate the corresponding group of transmission gates. The transmission gate group which is activated is strictly a function of the number of data bits/pixel. Thus, for example, when a 16 bit pixel bus is used (i.e. 16 bits are received at inputs $P_0$ to $P_{15}$) and 2 bits per pixel are desired (i.e. 2-bit words are output on outputs $MD_0$ and $MD_1$) then LOAD will be a divide by eight of the DOT clock and tranmission gates 102 (the 2-bit group) will be activated. Similarly, if a 32 bit pizel bus is used (i.e. 32 bits are received at inputs $P_0$ to $P_{31}$ and 8 bits per pixel are desired (i.e. 8 bits are output on outputs $MD_0$ to $MD_7$) then LOAD will be a divide by four of the DOT clock and transmission gates 106 (the 8-bit group) will be activated. As a final example, when a 16 bit pixel bus is used and 4 bits per pixel are desired then LOAD will be a divide by eight of the DOT clock and transmission gates 104 (the 4-bit group) will be activated. In this manner, the activation of transmission gates 100/102/104/106 corresponds to the timing of control signal LOAD and the DOT clock.

In the VGA pass through mode, the VGA data appearing on VGA connector 43 (FIG. 4) is selected using multiplexers 110 and 112 and directly passed to the output latches 108. In a separate special nibble mode, one of two 4-bit nibbles comprising the 8-bit word appearing on latches 98*a*–98*h* is selected and passed through to output latches 108*a*–108*d*. The outputs of output latches 108*e*–108*h* are unused in the special nibble mode. The selection of the special nibble mode is made through the application of a signal N/F (nibble flag) to be described in further detail below. If the 4 least significant bits of the 8-bit word are desired, i.e., those appearing at the outputs of latches 208*a*–208*d*, multiplexers 110 merely pass the data appearing at the outputs of latches 98*a*–98*d* directly to outputs MD0–MD3. If, on the other hand, the four most significant bits of the 8-bit word, i.e., those signals appearing at the outputs of latches 98*e*–98*h*, are desired, then the four most significant bits are shifted upward four bits by multiplexers 110 and 112. Specifically, the output of latch 98*e* is now coupled to the input of latch 108*a* through multiplexer 110*a*, the output of latch 98*f* coupled to the input of latch 108*b* by multiplexer 110*b*, the output of latch 98*g* coupled to the input of latch 108*c* by multiplexer 110*c* and finally, the output of latch 98*h* is coupled to the input of latch 108*d* by multiplexer 110*d*.

Figure 7:
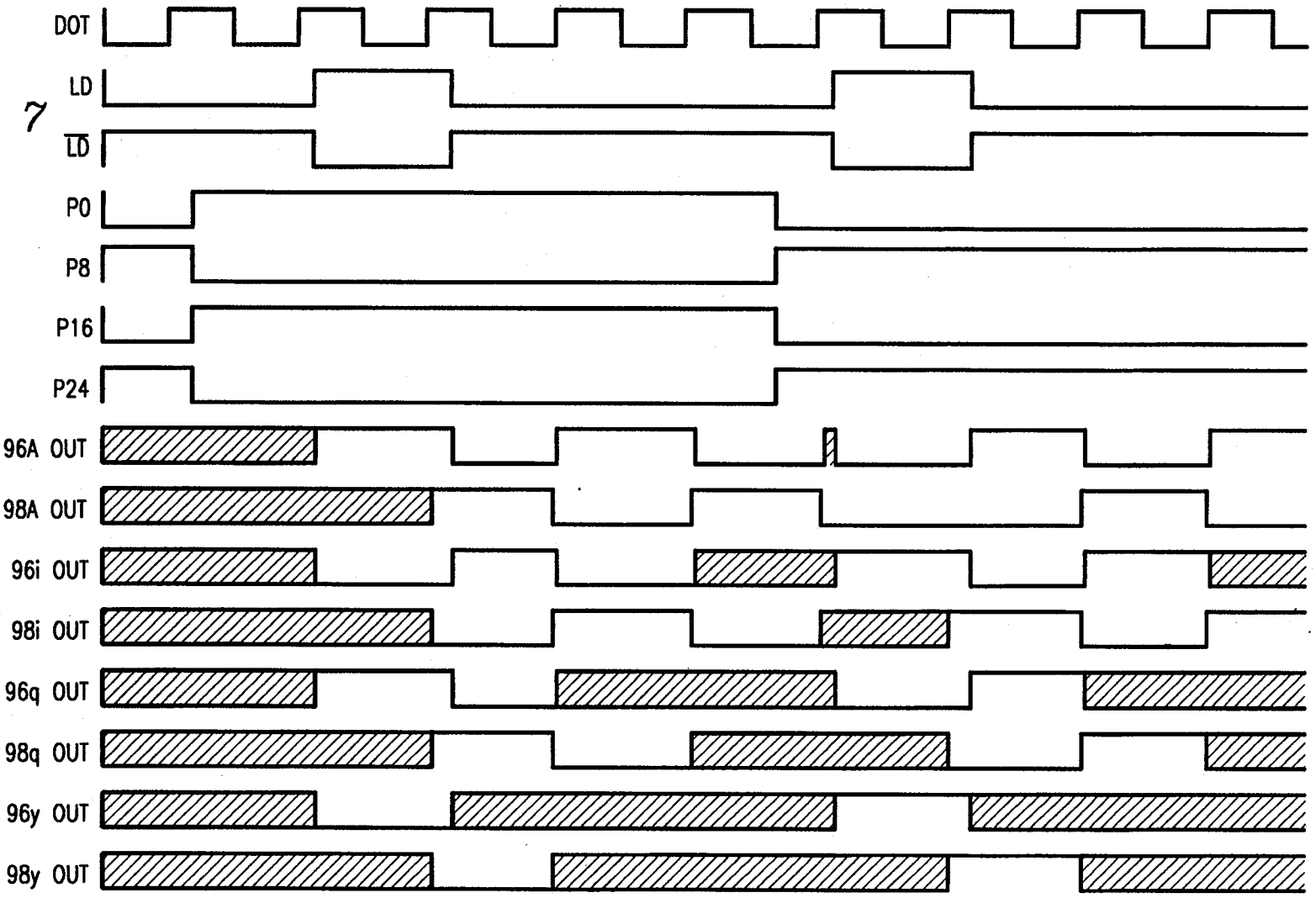
FIG. 7 is a timing diagram illustrating the operation of the selector of FIG. 6.

Referring to the timing diagram of FIG. 7, a brief example will demonstrate the operation of the improved frame buffer 78 according to the present invention. In this example, the pixel bus width (the number of bits of color codes received from video RAM 30) has been selected to be 32 bits while the number of bits per pixel (i.e. the number of bits of address being output to palette RAM 76 to access a color data word for a single pixel) has been selected to be 8. In the example configuration therefore, each 32-bit word of color codes delivered from video RAM 30 provides four 8-bit addresses to access color data words for four pixels. For this data configuration, four DOT clock intervals are provided during the LD interval. For convenience, FIG. 7 only shows the timing for the first bit in each 8-bit address being received as part of the 32-bit data word received at inputs $P_0$–$P_{31}$ and output on outputs MD0–MD7. On the receipt of LD, the 32 bits of data appearing at inputs P0–P31 (the current 32 bits) are passed through multiplexers 96 to the input of latches 98. On the first DOT clock after LD the current 32 bits are latched by latches 98 while at the same time the last 8-bit word latched into latches 98 with the last 32-bit word are latched and output by latches 108. On the second DOT clock after LD the first 8-bit address is latched and output by latches 108 and at the same time the other three 8-bit words are shifted, up by eight bits each. On the third DOT clock, the second 8-bit address is output and the remaining two words shifted upward 8-bits each. Similarly, on the fourth clock, the third 8-bit address is output. The last of the four 8-bit words is shifted on first DOT clock occurring immediately after the arrival of the next LD signal. In other words, the last 8-bit word is shifted, latched and output from latches 108 at the same time the next 32-bit word of color codes is latched into latches 98, as was done with the previous LD cycle.

Figure 8:
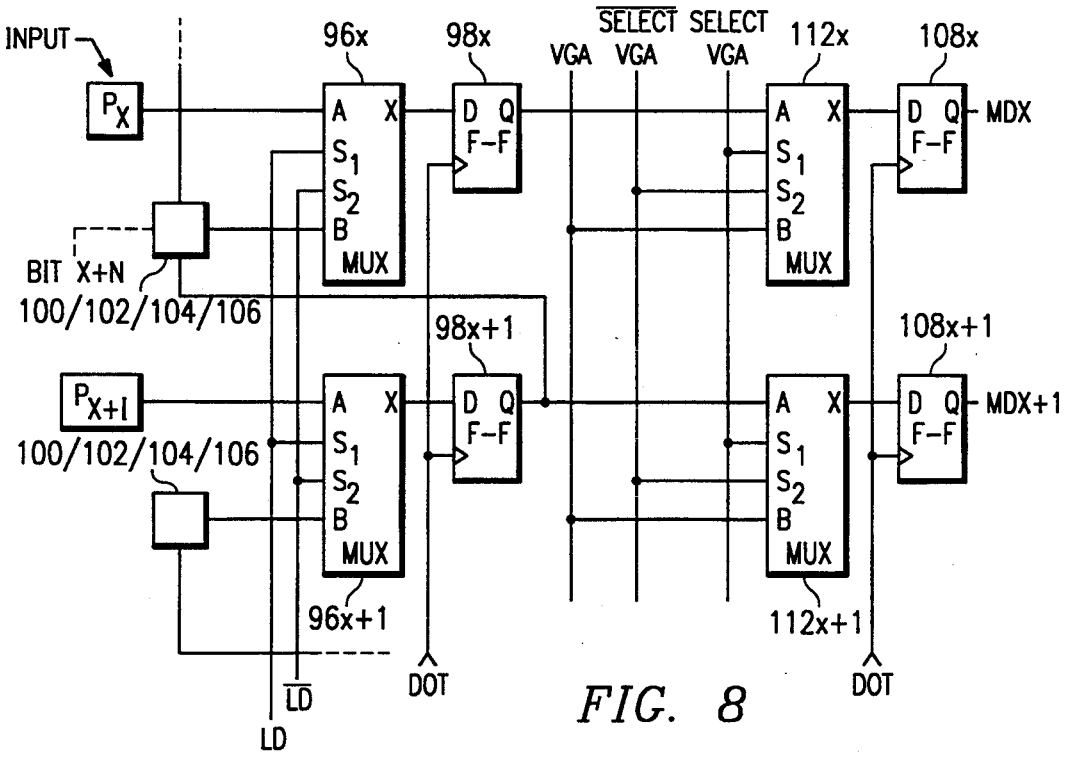

Referring next to FIG. 8, an enlarged schematic diagram depicts a alternate embodiment of a selected two bit path of the frame buffer of FIG. 6. In this embodiment, only 2:1 multiplexers 112 are being used allowing for VGA pass through only (with no 3:1 multiplexers 110 used and no provision for special nibble mode operation). Inputs $P_x$ and $P_{x+1}$ provide color code data from video RAM 20 to the A inputs of the corresponding multiplexers 96. The transmission gates 100/102/104/106 couple "wrap data" from bit paths x+n to the respective B inputs of corresponding multiplexers 96x and 96x+n. The output X of multiplexer 96x is coupled to the D input of latch 98x while the output X of multiplexer 96x+1 is coupled to the D input of latch 98x+1. The B input of latch 96x is coupled to the Q output of latch 96x+n while the B input of multiplexer 96x+n is coupled to a more significant bit as indicated in FIGS. 5 and 6. The $S_1$, inputs of both multiplexer 96x and multiplexer 96x+1 are coupled to signal LD. The clock inputs of latches 98x and 98x+1 are coupled to clocking signal DOT. The Q outputs of latches 98x and 98x+1 are coupled to the respective inputs of 2:1 multiplexers 112x and 112x+1. The B inputs of multiplexers 112x and 112x+1 are coupled to VGA port 43 for the receipt of VGA pass through data. The $S_1$ control inputs of multiplexers 112 are coupled to a signal SELECT VGA while the $S_2$ control inputs are coupled to the complement SELECT VGA. The X outputs of latches 112x and 112x+1 are coupled to respective D inputs of latches 108x and 108x+1, which are also clocked by signal DOT. The Q outputs of latches 108 in turn provide the outputs of frame buffer 42, $MD_x$ and $MD_{x+1}$.

Figure 9:
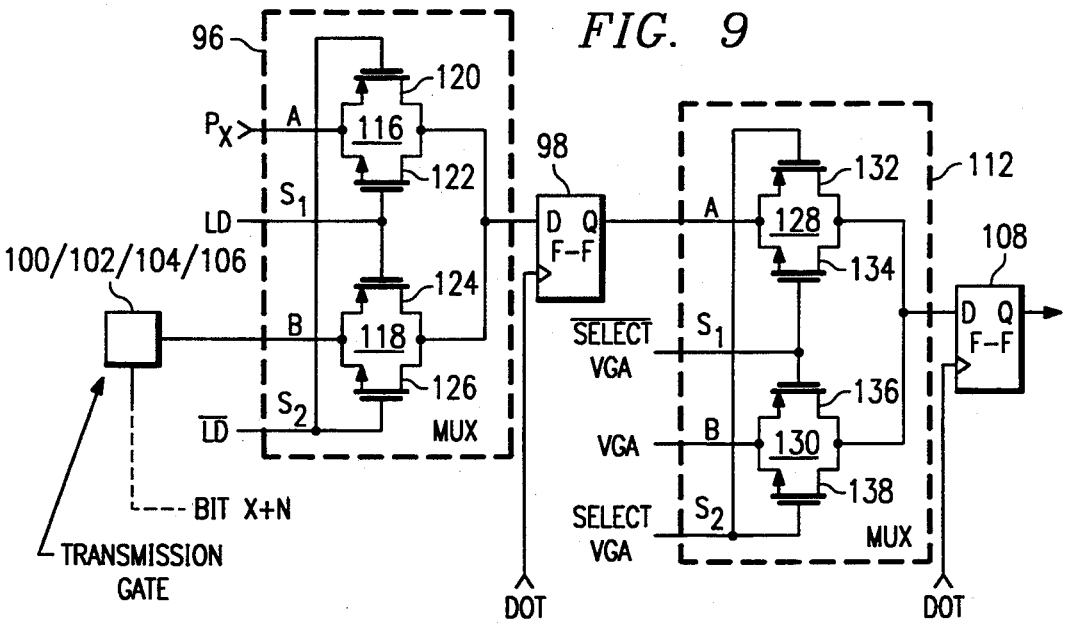
FIG. 9 is an electrical schematic diagram of a first embodiment of a selected one of the bit paths shown in FIG. 8.

Referring next to FIG. 9, a first implementation of the multiplexer circuitry for a typical bit path shown in FIGS. 6 and 8 is depicted. The embodiment of FIG. 9 has the primary advantage of speed. Multiplexer 96 comprises a pair of transfer gates 116 and 118. Transfer gate 116 is formed by back-to-back field effect transistors 120 and 122, transistor 120 being a p channel transistor and transistor 122 being an n channel transistor. Similarly, transfer gate 118 is comprised of back-to-back field effect transistors 124 and 126. Transistor 124 comprises a p channel transistor while transistor 126 comprises an n channel transistor. When LD is high (and correspondingly $\overline{LD}$ is low) transfer gate 116 passes data received the corresponding input Px. When $\overline{LD}$ is high (and correspondingly LD is low) "wrap data" received from the output of latch 98 of a more significant bit Px+n is passed.

Multiplexer 112 includes transfer gates 128 and 130. Transfer gate 128 is formed by the back-to-back coupling of p channel transistor 132 and n channel transistor 134. Similarly, transfer gate 130 is formed by the back-to-back coupling of a p channel transistor 136 and an n channel transistor 138. Transfer gate 128-controls the flow of data from latch 98 to latch 108 while transfer gate 130 controls the pass through of VGA data to latch 108. Control of transfer gates 128 and 130 is implemented through signal SELECT VGA The gate of transistor 134 of transfer gate 128 is coupled to the gate of transistor 136 of transfer gate 130 and both are coupled to control signal SELECT VGA. The gate of transistor 132 of transfer gate 128 is coupled to the signal as is the gate of transistor 138 of transfer gate 130. When SELECT VGA is set high transfer gate 128 passes data from latch 98 while when SELECT VGA is set high, VGA data received on VGA port 43 is passed to output latch 108.

Figure 10:
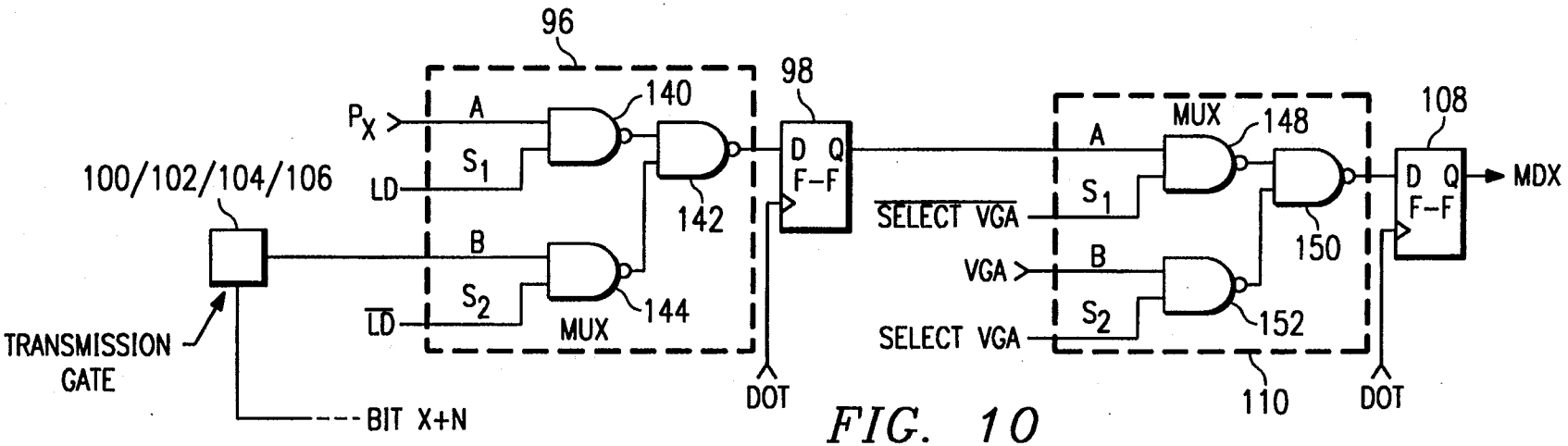
FIG. 10 is an electrical schematic diagram of a second embodiment of a selected one of the bit paths shown in FIG. 8.

Referring next to FIG. 10, a typical bit path described in FIGS. 6 and 8 is shown emphasizing a second implementation of multiplexers 96 and 110. The implementation depicted in FIG. 10 has the significant advantage of reliability. Multiplexer 96 is comprised of NAND gates 140, 142 and 144. The first (A) input of NAND gate 140 receives data from input pin Px while the second ($S_2$) input of gate 140 receives the complement of control signal LD ($\overline{LD}$). The first (B) input of NAND gate 144 receives the "wrap data" from bit x+n via one of gates 102–106 while the second input of NAND gate 144 receives control signal LD. The respective outputs of NAND gates 140 and 144 are then input into NAND gate 142 whose output is then fed to latch 98. Thus, when control signal LD is high, data from input $P_x$ is passed to latch 98 while when $\overline{LD}$ is high (and LD is low) "wrap data" from x+n is passed.

In a similar fashion, multiplexer 110 comprises NAND gates 148, 150 and 152. NAND gate 148 receives the output of latch 98 at its first (A) input and the complement of control signal SELECT VGA (SELCT VGA) at its second ($S_1$) input. NAND gate 152 receives VGA pass-through data at its first (B) input and control signal SELECT VGA at its second ($S_2$) input. The respective outputs of NAND gates 148 and 152 are then input into NAND gate 150. The output of NAND gate 150 is then fed to output latch 108. When SELECT VGA is set high, data are passed through from latch 98 while when SELECT VGA is high, VGA data from VGA connector 43 (FIG. 4) is passed to output latch 108.

Figure 11:
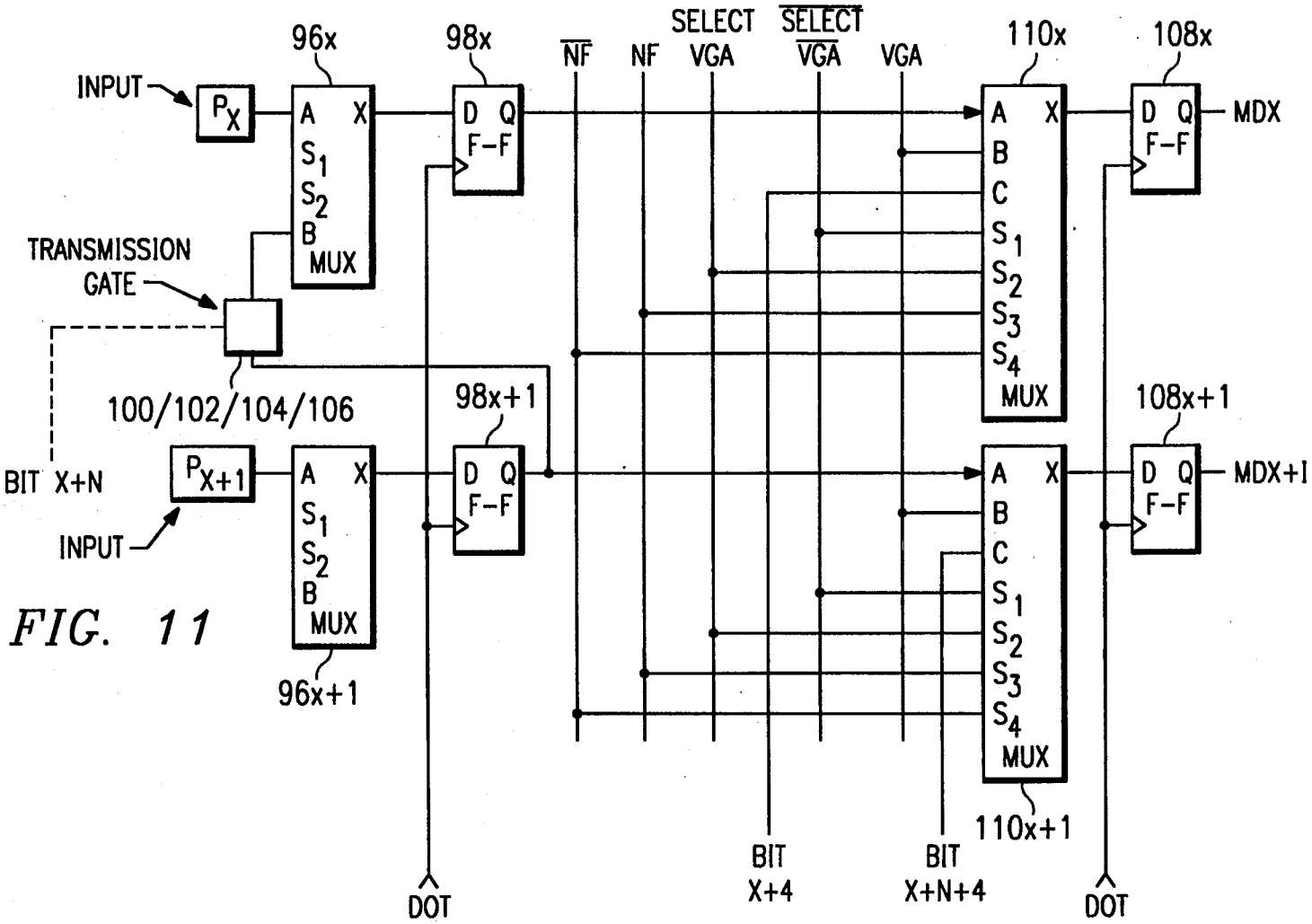
FIG. 11 is a functional block diagram of a selected pair of the bit paths shown in FIG. 6 including provision for VGA pass through and NIBBLE MODE operation.

FIG. 11 is a more detailed depiction of the circuitry comprising the data paths for inputs $P_x$ and $P_{x+1}$, including the provision for the special nibble mode. In the embodiment shown in FIG. 11, the data paths passing data received at inputs $P_x$ and $P_{x+1}$ implement the 3:1 multiplexers 110 shown in FIG. 6. Multiplexers 110 allow the pass through to output latches 108 of either data directly from latches 98*a* and 98*b*, VGA pass through data or "wrap data" shifted from more significant bit (BIT x+n) latches 98 below (not shown). The A data inputs of multiplexers 110 is coupled to respective Q outputs of the corresponding latches 98, the B data inputs coupled to VGA pass through terminal 43 and C data inputs coupled to the output of latch 96 of the bit path four bits below (the output of latch 96 for bit path x+4 coupled to the C input of multiplexer 110 as shown in (FIG. 6).

Figure 12:
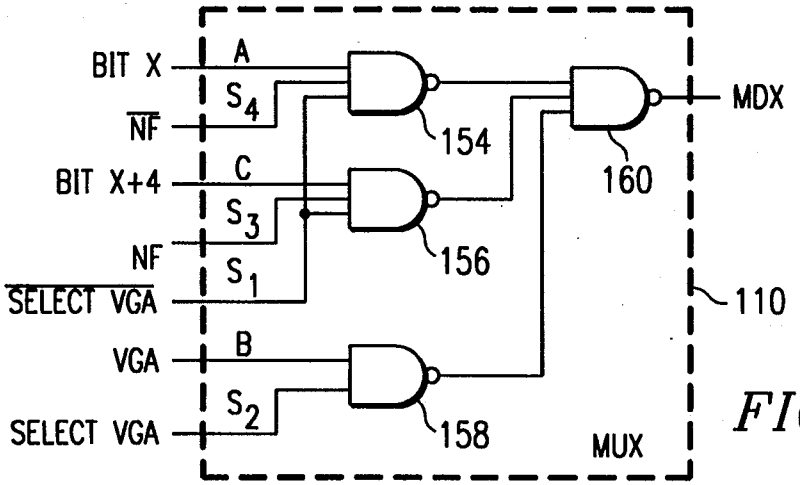
FIG. 12 is an electrical schematic diagram depicting one embodiment of a selected one of the 3:1 multiplexers depicted in FIG. 11.

FIG. 12 illustrates an implementation of a 3:1 multiplexer 110 as shown in FIGS. 6 and 11. A three input NAND gate 154 provides the data A, $\overline{NF}$ (NIBBLE FLAG) and SELECT VGA inputs. A second three input NAND gate 156 provides the data C, NF (NIBBLE FLAG) and is also coupled to SELECT VGA. A two input NAND gate 158 provides inputs data B and SELECT VGA. The outputs of NAND gates 154, 156 and 158 are coupled to the respective inputs of three input NAND gate 160, the output of which provides the circuit output $MD_x$. In this configuration, data is passed from the corresponding latch 98 through input A to output $MD_x$ when control signal NF (NIBBLE FLAG) and control signal SELECT VGA are set low (and correspondingly complements $\overline{NF}$ and SELECT VGA are set high). Special nibble mode shifting between multiplexers 110 and 112 occurs when control signal NF (NIBBLE FLAG) is set high (and correspondingly the complement $\overline{NF}$ is set low) and SELECT VGA is set low (and correspondingly SELECT VGA is set high). A VGA bit of data is passed through from VGA connector 43 when control signal SELECT VGA is set high (and correspondingly SELECT VGA is set low) and control signal NF (NIBBLE FLAG) is set low (and correspondingly $\overline{NF}$ is set high).

While preferred embodiments of the invention and their advantages have been set forth in the above-detailed description, the invention is not limited thereto, but only by the scope and spirit of the appended claims.

What is claimed is:

1. A buffer, comprising:

a plurality of sequentially ordered input modes, each node operable to receive one bit of a data word;

a plurality of sequentially ordered multiplexing circuits, each multiplexing circuit having a first input coupled to a respective input node;

first control circuitry for selectively coupling a second input of each multiplexer circuit to an output of a selected one of a plurality of subsequent multiplexing circuits, each of said plurality of subsequent multiplexing circuits separated from said multiplexer circuit by a predetermined number of multiplexing circuits equal to $2^N$, where N is a positive integer, said multiplexer circuits not having such a subsequent multiplexer circuit having said second input not connected;

second control circuitry coupled to each said multiplexing circuit for selecting between said first and second inputs; and a plurality of outputs coupled to said multiplexing circuits for outputting the groups of bits, each group of bits having a predetermined number of bits.

2. The frame buffer of claim 1, wherein said first control circuitry comprises:

a plurality of first latches, each said first latch coupled between a respective one of said multiplexing circuits and a respective one of said outputs; and at least one transmission gate associated with a second input of each multiplexing circuit for coupling a second input of said associated multiplexing circuit to said output of said subsequent multiplexing circuit.

3. The frame buffer of claim 2, and further comprising a plurality of second latches, each of said second latches having an input connected to a respective said output of a selected one of said first latches.

4. The frame buffer of claim 2, wherein said multiplexing circuits comprise a sequentially ordered array k of multiplexing circuits, said first latches comprising a sequentially ordered array k of latches, each said multiplexing circuit associated with a respective sequentially ordered array of j transmission gates, an mth one of said transmission gates associated with an $(n-2^{m-1})$th one of said multiplexing circuits operable to couple an input of said $(n-2^{m-1})$ multiplexing circuit to an output of an nth one of said first latches, j, k, m, and n are positive integers, j and k are constants, m is a variable between 1 and j, and n is a variable that is greater than $2^{m-1}$.

5. The buffer of claim 4, wherein j equals 4.

6. The buffer of claim 4, wherein k equals 32.

7. The buffer of claim 4, wherein k/j is an integer.

8. The buffer of claim 7, wherein k/j is a power of two.

* * * * *